United States Patent [19]

Kanzaka

[11] Patent Number: 4,562,624

[45] Date of Patent: Jan. 7, 1986

[54] SNAP FASTENER FOR USE ON GARMENTS

[75] Inventor: Yoshihiro Kanzaka, Nyuzen, Japan

[73] Assignee: Nippon Notion Kogyo Co., Ltd., Tokyo, Japan

[21] Appl. No.: 442,462

[22] Filed: Nov. 17, 1982

[30] Foreign Application Priority Data

Dec. 7, 1981 [JP] Japan ..... 56-181928[U]

[51] Int. Cl.[4] ..... A44B 17/00

[52] U.S. Cl. ..... 24/621; 24/623; 24/681; 24/691

[58] Field of Search ..... 24/90 R, 90 A, 90 C, 24/90 E, 94, 105, 107, 108, 104, 106, 614, 615, 618–620, 662, 664, 679–682, 687–691, 693, 700, 621–624

[56] References Cited

U.S. PATENT DOCUMENTS

| | | | |
|---|---|---|---|
| 607,022 | 7/1898 | Dowse | 24/681 X |
| 1,452,052 | 4/1923 | Nalle | 24/90 C |
| 1,589,158 | 6/1926 | Hedison | 24/90 C |
| 1,782,165 | 11/1930 | Ford | 24/691 |
| 2,254,418 | 9/1941 | Carley | 24/95 X |
| 2,901,796 | 9/1959 | Hope | 24/108 |
| 2,902,735 | 9/1959 | Holdsworth | 24/105 |
| 3,107,408 | 10/1963 | Huelster et al. | 24/621 |
| 3,195,201 | 7/1965 | Ash, II | 24/689 |
| 3,979,802 | 9/1976 | Bougartz et al. | 24/689 X |
| 4,402,116 | 9/1983 | Schenk | 24/662 |

FOREIGN PATENT DOCUMENTS

| | | | |
|---|---|---|---|
| 710996 | 6/1965 | Canada | 24/90 |
| 364426 | 11/1922 | Fed. Rep. of Germany | 24/623 |
| 55-62214 | 4/1980 | Japan . | |
| 56-104602 | 8/1981 | Japan . | |
| 542153 | 12/1941 | United Kingdom | 24/217 |
| 1073408 | 6/1967 | United Kingdom | 24/217 |

*Primary Examiner*—William E. Lyddane
*Assistant Examiner*—James R. Brittain
*Attorney, Agent, or Firm*—Hill, Van Santen, Steadman & Simpson

[57] ABSTRACT

A snap fastener for use on garment pieces comprises a male member attached by a first rivet to one of the garment pieces and a female member attached by a second rivet to the other garment piece. The male member includes a first cylindrical wall having an annular rim snapped in an annular groove defined in a second cylindrical wall of the female member. The male member and the first rivet have reinforcing ribs biting in the garment piece sandwiched therebetween, and similarly the female member and the second rivet have reinforcing ribs held in biting engagement with the garment sandwiched therebetween. The male and female members, and the first and second rivets are prevented by these reinforcing ribs from rotating with respect to the garment pieces, an advantage which manifests itself especially where the first and second rivets have directional ornamental patterns on their heads. The first and second cylindrical walls of the male and female members have slots and cavities to allow the annular rim to resiliently fit snappingly into the annular groove without cracking or deforming the male and female members. The first and second rivets have pointed shanks piercing the garment pieces and fitted in the male and female members, respectively. The pointed shanks have angularly spaced ridges held in frictional engagement with the male and female members to prevent angular play between the first and second rivets and the male and female members.

1 Claim, 6 Drawing Figures

SNAP FASTENER FOR USE ON GARMENTS

BACKGROUND OF THE INVENTION

1. Field of the Invention

The present invention relates to a snap fastener of synthetic resin for use on garments.

2. Prior Art

Various snap fasteners are known which comprise male and female members of synthetic resin staked on garment pieces by rivets of synthetic resin. The male and female members as thus attached tend to suffer from unwanted angular plan with respect to the rivets during use since the rivets as staked by cold forming cannot secure the male and female members with a sufficient amount of force comparable with that given by staked metal members. Another source of such backlashes is dimensional errors made during the fabrication of the male and female members and the rivets. The snap fastener with the backlashes is liable to rotate with respect to the garment pieces, a condition which is disadvantageous particularly where a directional decorative pattern is marked on the heads of the rivets. One solution to such a problem would be to insert rivet shanks of a larger diameter forcibly into holes of a smaller diameter in the male and female members to retain the rivets frictionally on the male and female members. However, forced insertion of the rivet shanks into the holes in the male and female members could crack the latter in the process of assembly, and the assembled snap fastener would be broken apart or become useless in a short period of time.

SUMMARY OF THE INVENTION

It is an object of the present invention to provide a snap fastener which, when attached to a garment, will be free from angular plan and prevented from unwanted rotation with respect to the garment.

Another object of the present invention is to provide a snap fastener having a relatively long service life.

According to the present invention, a male member includes a bottom having a plurality of first radial reinforcing ribs, and a first rivet includes a head having a plurality of second radial reinforcing ribs. The first rivet has a pointed shank extending remotely from the head and frictionally inserted through a garment piece into a central hole in the bottom of the male member with the first and second radial reinforcing ribs biting into the garment piece, preventing the male member and the first rivet from rotating with respect to the garment piece. The pointed shank has a plurality of angularly spaced ridges extending axially thereof from the head and terminating short of the pointed end. Likewise, a female member includes a bottom having a plurality of third radial reinforcing ribs, and a second rivet includes a head having a plurality of fourth radial reinforcing ribs. The second rivet has a pointed shank extending remotely from the head thereof and frictionally inserted through another garment piece into a central hole in the bottom of the female member with the third and fourth radial reinforcing ribs biting into the garment piece, preventing the female member and the second rivet from rotating with respect to the garment piece. The pointed shank of the second rivet also has a plurality of angularly spaced ridges extending axially thereof from the head of the second rivet and terminating short of the pointed end. The male and female members have cylindrical walls snappingly fittable together to thereby assemble a snap fastener.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 1:
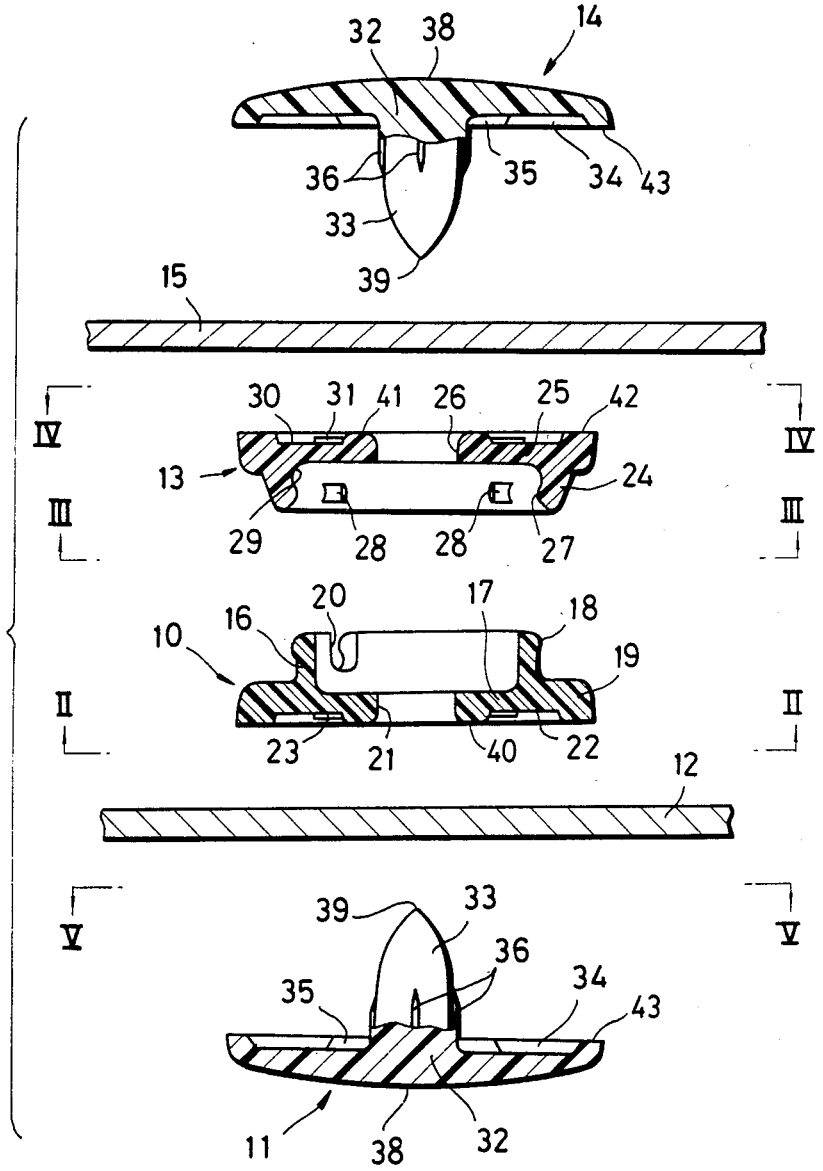
FIG. 1 is an axially exploded cross-sectional view of a snap fastener according to the present invention, the snap fastener being shown unassembled prior to attachment to a garment.

As shown in FIG. 1, a snap fastener comprises a male member or hook 10, a first rivet 11 connectable to the male member 10 with a garment piece 12 sandwiched therebetween, a female member or socket 13, and a second rivet 14 combinable with the female member 13 with another garment piece 15 placed therebetween.

Figure 2:
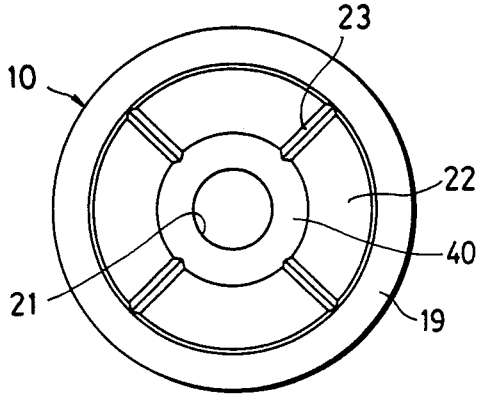
FIG. 2 a bottom view of a male member of the snap fastener, taken along line II—II of FIG. 1.

The male member 10 has a cylindrical wall 16 including a bottom 17 and a rim 18 remote from the bottom 17 and projecting radially outwardly. The cylindrical wall 16 also has a flange 19 lying substantially flush with the bottom 17 and extending radially outwardly. A plurality of angularly spaced slots 20 (one shown in FIG. 1) are defined in the rimmed end of the cylindrical wall 16 to render the latter resilient relatively to the rest of the male member 10. The bottom 17 has a central hole 21. An annular recess 22, which is concentric with the central hole 21, is defined in the bottom 17 by an inner flange 40 and the outer flange 19 and opens away from the cylindrical wall 16. Thus the flanges 19 and 40 are axially facing or directed at the recess 22. As best illustrated in FIG. 2, a plurality (four in the illustrated embodiment) of radial reinforcing ribs 23 of a triangular cross section are disposed in the recess 22 at angularly equidistant locations.

Figure 3:
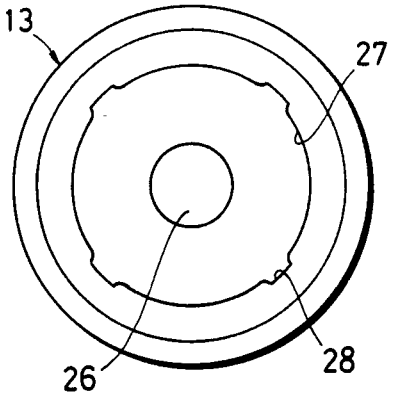
FIG. 3 is a plan view of a female member of the snap fastener, taken along line III—III of FIG. 1.
Figure 4:
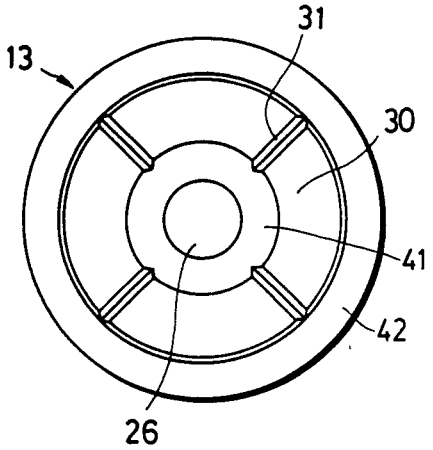
FIG. 4 is a bottom view of the female member taken along line IV—IV of FIG. 1.

The female member 13 as shown in FIG. 1 is composed of a cylindrical wall 24 including a bottom 25 having a central hole 26 and an annular locking edge 27 projecting radially inwardly and located remotely from the bottom 25. The cylindrical wall 24 has a plurality (four as shown in FIG. 3) of angularly equidistant cavities 28 defined in its radially inward surface to provide the cylindrical wall 24 with resiliency relative to the rest of the female member 13. The cylindrical wall 24 also has an annular groove 29 defined between the locking edge 27 and the bottom 25. The ribs 35 have a triangular cross-section, overlie the inner flanges 40, 41 and terminate short of the outer flanges 42, 43. The bottom 25 has an annular recess 30 defined by an inner axially directed flange 41 and an outer axially directed flange 42, and opening away from the cylindrical wall 24 and having a plurality (four as shown in FIG. 4) of radial reinforcing ribs 31 of a triangular cross section.

Figure 5:
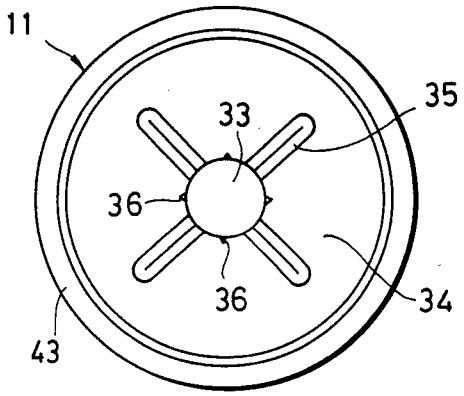
FIG. 5 is a bottom view of a rivet for use with the male or female member, taken along line V—V of FIG. 1.

The first and second rivets 11, 14 are of an identical structure. Each rivet 11, 14 includes a head 32 having a round surface 38 and a central shank 33 having a pointed end 39. The head 32 has an annular recess 34 defined in part by a further outer axially directed flange 43, and opening away from the round surface 38 and also has a plurality (four as shown in FIG. 5) of angularly equally spaced reinforcing ribs 35 extending radially outwardly from the shank 33. The shank 33 has a plurality (four as shown) of ridges 36 extending axially from the head 32 and terminating substantially midway in the axial length of the shank 33. The ridges 36 are triangular in cross section as shown in FIG. 5 and one each located angularly midway between the two adjacent reinforcing ribs 35. The ridges 36 have radially outward edges which jointly define an outside diameter slightly larger than the inside diameter of the central holes 21, 26 in the male and female members 10, 13. Although not shown, the round head 38 may be marked with a desired decorative pattern that may be directional with respect to the garment piece 12 or 15.

Figure 6:
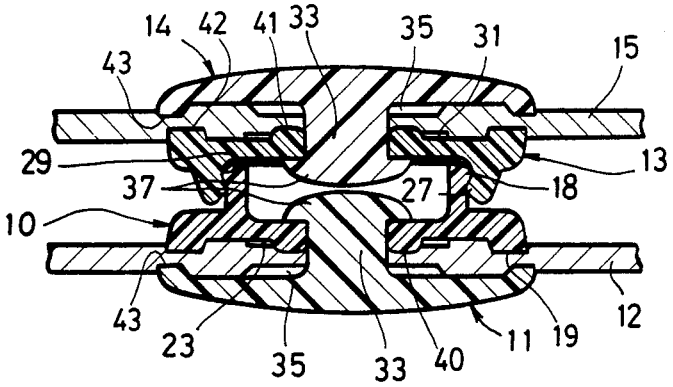
FIG. 6 is an axial cross-sectional view of the snap fastener as assembled on a garment.

In assembly, the rivets 11, 14 are attached respectively to the male and female members 10, 13 by forcing the shanks 33, 33 to pierce the garment pieces 12, 15 and enter the holes 21, 26, respectively, in frictional engagement with the bottoms 17, 25 of the male and female members 10, 13. Then, as shown in FIG. 6, the pointed ends 39, 39 of the shanks 33, 33 are flattened as by a punch to form flattened and spread ends 37, 37, by which the shanks 33, 33 are firmly staked on the male and female members 10, 13, respectively, with the garment pieces 12, 15 securely sandwiched therebetween. The male member 10 thus attached to the garment piece 12 by the rivet 11 can be inserted into the female member 13 until the rim 18 is snapped into the annular groove 29 past the locking edge 27. Since the cylindrical walls 16, 24 are relatively resilient, they are elastically deformable when they are to be combined together and hence are free from undue stresses that could otherwise damage the cylindrical walls 16, 24.

As assembled, the ridges 36 bite into inner wall surfaces defining the holes 21, 26 in the male and female members 10, 13 to thereby prevent the rivets 11, 14 from rotating with respect to the male and female members 10, 13, respectively, due to increased frictional engagement therebetween. Therefore, the directional decorative patterns on the rivet heads 32 remain oriented as desired on the garment pieces 12, 15 without the danger of being accidentally turned away or disoriented in response to applied external forces. The reinforcing ribs 23, 31 on the male and female members 10, 13 and the reinforcing ribs 35, 35 on the rivets 11, 14 are caused to bite into the garment pieces 12, 15 so that the male and female members 10, 13 and the rivets 11, 14 can be prevented from rotating with respect to the garment pieces 12, 15. The flattened ends 37, 37 maintain an axial compressive force acting on the garment pieces 12, 15, and the presence of the annular recessess 22, 30, and 34 also concentrates these compressive forces at the radially outermost margins of the male and female members 10, 13 and the rivets 11, 14 as shown in FIG. 6 by the compression of the garment pieces 12, 15. To the extent that a reactive force caused by friction between the garment pieces 12, 15 and such assembled outermost margins will also oppose relative rotation with respect to the garment pieces, the effect of such reactive force is maximized in that it will act through the longest moment arm, namely the radius of the grommet. The frictional engagement between the shanks 33, 33 with the male and female members 10, 13 eliminates any angular play which would otherwise result from dimensional errors made during the manufacture of the male and female members 10, 13 and the rivets 11, 14. The male and female members 10, 13 and the rivets 11, 14 may be relatively thin as the reinforcing ribs 23, 31 and 35 provide a sufficient degree of mechanical strength which protects these snap fastener components against cracks or deformation during assembly or use, thus enabling the snap fastener to have a prolonged service life.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A snap fastener of resilient synthetic resin for use on garment pieces, comprising:

(a) a male member adapted to be mounted on one of the garment pieces and including a first bottom having a first cylindrical wall on one side thereof, a first central opening through said first bottom, a first annular recess on the other side of said first bottom around said first central opening, thereby defining inner and outer axially directed flanges, and a set of four first radial ribs of a triangular cross section extending radially outwardly from said inner flange entirely across said first annular recess;

(b) a first rivet said male member, having a first head with a first central shank receptive in said first central opening, said first rivet having a second annular recess around said first shank, thereby defining a further outer axially directed flange, said first rivet having a set of four second radial ribs of a triangular cross section extending radially outwardly from said first central shank into said second recess and terminating short of said further outer flange, said first central shank having a set of four first straight ridges of triangular cross-section extending axially from said first head for biting into said first bottom, and disposed angularly between said second radial ribs;

(c) a female member adapted to be mounted on another of the garment pieces and including a second bottom having a second cylindrical wall on one side thereof for snappingly axially receiving said first cylindrical wall, a second central opening through said second bottom, a third annular recess on the other side of said second bottom around said second central opening, thereby defining additional inner and outer flanges directed axially away from said flanges of said male member, and a set of four third radial ribs of a triangular cross section extending radially outwardly from said additional inner flange entirely across said third annular recess; and (d) a second rivet for said female member, having a second head with a second central shank receptive in said second central opening, said second rivet having a fourth annular recess around said second shank, thereby defining a still further outer axially directed flange, said second rivet having a set of four fourth radial ribs of a triangular cross section extending radially outwardly from said second central shank into said recess and terminating short of said still further outer flange, said second central shank having a set of four second straight ridges of triangular cross-section extending axially from said second head for biting into said second bottom, and disposed angularly between said fourth radial ribs.

* * * * *